US005156586A

United States Patent [19]

Fitch, Jr. et al.

[11] Patent Number: 5,156,586

[45] Date of Patent: Oct. 20, 1992

[54] ORBITAL SEPARATOR FOR ORBITALLY SEPARATING A MIXTURE

[75] Inventors: Ernest C. Fitch, Jr.; Ing T. Hong, both of Stillwater, Okla.

[73] Assignee: Bardyne, Stillwater, Okla.

[21] Appl. No.: 550,375

[22] Filed: Jul. 10, 1990

[51] Int. Cl.[5] ..... B04B 1/08

[52] U.S. Cl. ..... 494/67; 210/377; 494/60

[58] Field of Search ..... 494/37, 43, 60, 65, 494/66, 67, 78, 85; 366/167-170, 174, 175, 305; 210/377, 360.1

[56] References Cited

U.S. PATENT DOCUMENTS

| | | | |
|---|---|---|---|
| 544,080 | 8/1895 | Bachmann | 494/60 X |
| 726,948 | 5/1903 | Land | 494/67 |
| 957,250 | 5/1910 | Ponten | 210/360.1 X |
| 1,043,947 | 11/1912 | Maassen | 210/377 X |
| 1,724,254 | 8/1929 | Buckbee | 494/67 X |
| 2,808,200 | 10/1957 | Wishaw | 494/67 |
| 3,703,984 | 11/1972 | Pruessner | 494/66 X |
| 4,175,873 | 11/1979 | Iwako et al. | 366/305 X |

FOREIGN PATENT DOCUMENTS

| | | | |
|---|---|---|---|
| 292976 | 7/1916 | Fed. Rep. of Germany | 494/85 |
| 10614 | 10/1901 | Norway | 494/85 |
| 452363 | 4/1975 | U.S.S.R. | 210/360.1 |
| 1214216 | 2/1986 | U.S.S.R. | 494/65 |
| 337628 | 11/1930 | United Kingdom | 494/67 |

*Primary Examiner*—Harvey C. Hornsby
*Assistant Examiner*—C. Cooley
*Attorney, Agent, or Firm*—Head & Johnson

[57] ABSTRACT

An orbital separator for separating the components of a mixture by introducing a flow of the mixture into a container which has therein an axial mounted member for directing the flow of the mixture to the periphery of the container and which allows removal of the separated components of the mixture.

17 Claims, 6 Drawing Sheets

ORBITAL SEPARATOR FOR ORBITALLY SEPARATING A MIXTURE

BACKGROUND OF THE INVENTION

1. Field of Invention

This invention relates to rotational devices for separating components of a mixture, such as centrifuges.

A separator, by definition, isolates and classifies substances of all types: gases, liquids and solids—according to their physical properties. Various types of separator mechanisms exist including inertial and centrifugal. An inertial separator is a kinetic device that exhibits cyclonic behavior by hydraulically accelerating the mixture to be separated in a circular path and uses the radial acceleration to isolate the components of the mixture. For example, in a hydrocyclone, fluid enters circumferentially at the top and the purified fluid migrates toward the center and out the central tube at the top while the separated denser material tends to stay near the outside wall where it proceeds downward to the underflow port. Separation occurs in a free vortex region.

A centrifugal separator is a kinematic device that achieves separation due to the centrifugal force created by the mechanical rotation of the system. In a conventional centrifuge, fluid normally enters at the center of a whirling mass then is pressed toward the outside by centrifugal force. More dense materials move toward the outside while less dense materials remain on the inside.

One of the problems with commercially available centrifugal separators or centrifuges is that a gradient flow exists to perpetuate eddy currents that cause turbulent mixing of the components of the mixture. This is one of the main reasons why many circulating centrifuges exhibit poor separation efficiencies. The ultra-high rotational speed required to achieve micronic separation of components is evidence of the inefficiency exhibited by commercially available centrifuges.

The residence time provided by conventional centrifuges for components to be separated and to exit the circulating stream is recognized as another serious drawback in current designs. One of the reasons for this inadequacy is that the mixture is introduced near the center of rotation axially where the denser components must travel through the circulating layers of the mixture before they can reach the more stagnant, high energy orbital area near the periphery of the separation chamber—this assumes that a true stagnation zone actually exists in the first place.

Another characteristic of commercial centrifuges is that the less dense components of the mixture are forced to exit near the collection zone for the more dense components or to make abrupt turns at critical points within the system. In many cases, eddy currents are active and there is little control over recontamination of the separated components of the mixture.

SUMMARY OF THE INVENTION

This invention is a novel orbital separator for separating the components of a mixture. The preferred embodiment of this device includes an axially mounted tube, which acts as the center of rotation, as well as the intake and discharge member. A separation container surrounds the axial tube, forming a separation chamber in the area between the tube and the wall of the container. Both tube and container are rotated by a pulley or other means. A conical flow director is mounted on the tube in the chamber and acts to divert the flow of introduced mixture to the periphery of the chamber, and also is so shaped to prevent the mixture from moving to the axial position too rapidly, thus preventing turbulence. In operation, a mixture flow is introduced axially through the tube. This flow impacts the flow director and is diverted to the periphery of the chamber. More dense components remain at the periphery and less dense components migrate toward the central axial plane. The less dense components are then discharged through one or more openings into the tube. A plug in the tube, between the intake and discharge ports, prevents the intake and discharge area from mixing. The more dense components are discharged through a peripheral channel.

An optional feature of the device is the incorporation of at least one or a series of vertical radially oriented fins within the separation chamber which compartmentalize the flow of the mixture and facilitates solid body type rotation.

The mixture may be any combination of gases, liquids and/or solids. For example: gas-gas; gas-liquid; gas-solid; liquid-liquid; liquid-solid; liquid-gas-solid; or solid-solid—or a combination thereof. The solid-solid separation would require making the solids suitable for flow, which may be accomplished by suspension in a gas or liquid carrier. Separation may be continuous, periodic, or variable. Where there are multiple components, serial separations may be required.

DETAILED DESCRIPTION OF THE DRAWINGS

DETAILED DESCRIPTION OF PREFERRED EMBODIMENT

Figure 1:
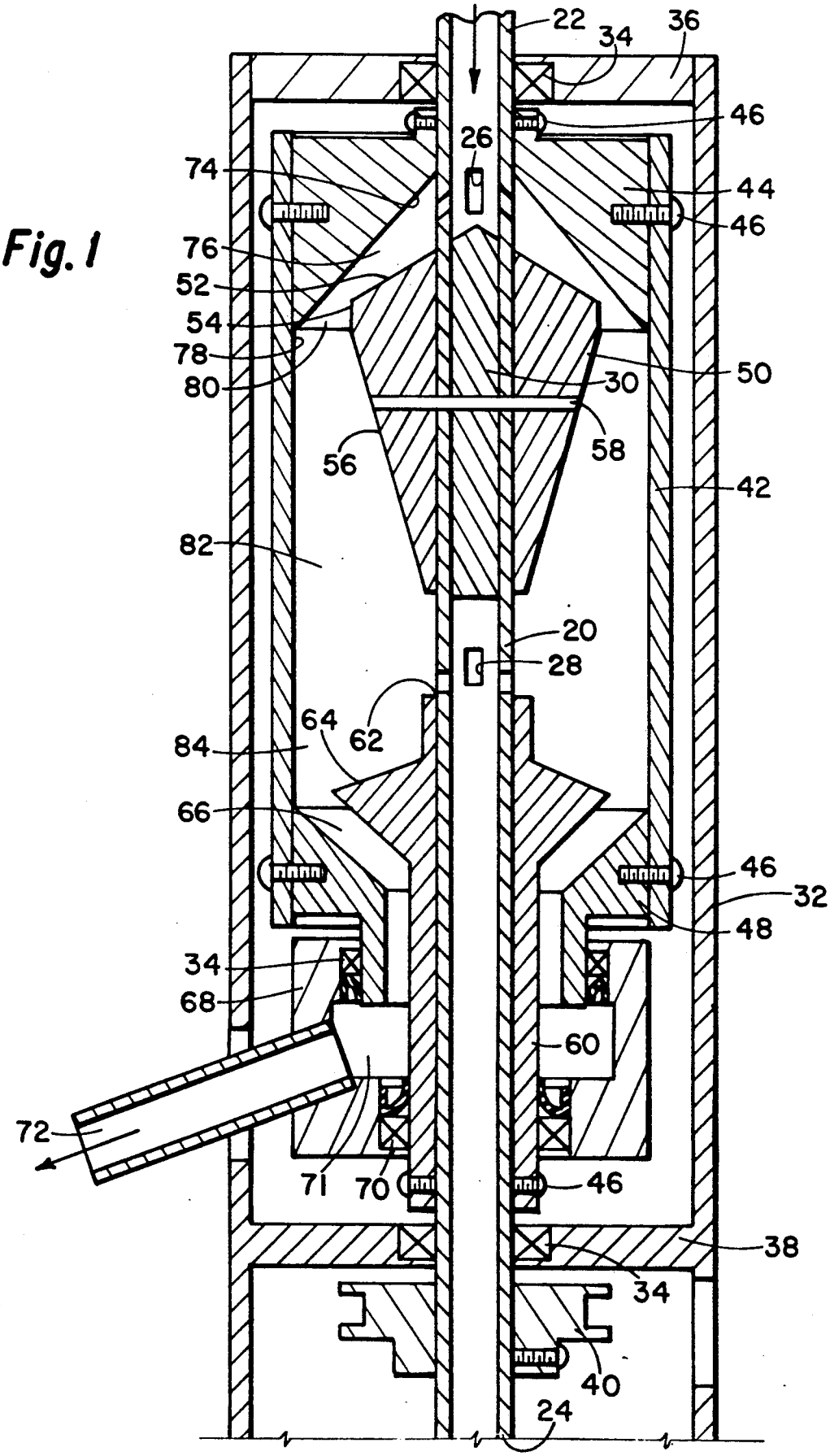
FIG. 1 is a longitudinal cross-sectional cut away view of the orbital separator device of the preferred embodiment of this invention for separating the components of a mixture.

The preferred embodiment is illustrated in FIG. 1. Structurally, this includes of an axial tube 20 which has an inlet end 22, a discharge end 24, inlet ports 26, discharge ports 28, and luminal plug 30. The tube may be formed of any suitable material, such as metal, plastic or the like. A means of controlling flow rates (not illustrated), such as a valve, spigot, or the like, may be attached at either, or both, the inlet end 22 and the discharge end 24.

The tube 20 is centrally, and axially, mounted in a housing 32 having a top plate 36 and a bottom plate 38.

The tube 20 extends through top plate 36 and bottom plate 38 and is supported therein by bearings 34 at the top plate and bottom plate so as to allow rotation of tube 20 within housing 32. The tube 20, near its discharge end 24 has an attached pulley 40 for supporting a belt (not illustrated) to rotate tube 20. Other means of rotation may be used, such as a hollow shaft motor, hydraulic means, pneumatic means, and the like.

The housing 32 may be made of any suitable material such as metal, plastic and the like. The device may operate without a housing. Between housing 32 and tube 20, a separation container 42 is supported from tube 20 such that rotation of tube 20 rotates the container 42. Container 42 is placed so that tube 20 is axially located in container 42. This container 42 may be made of metal, plastic, or other suitable material. In this embodiment, the container 42 is cylindrical, however, other shapes such as tear-drop, ovoid, spherical and the like are also functional.

The container 42 has a top member 44 which is retained within container 42 by screws 46, or other means. This top member 44 is annular in shape and closes the space between tube 20 and the inner wall of the container 42.

The container 42 has a bottom member 48 which is also retained within the container 42 by screws 46, or other means. This bottom member is annular in shape and partially closes the space between tube 20 and the inner wall of container 42 and is located at the opposite end of container 42 from top member 44. Both the top member 44 and the bottom member 48 may be formed of metal, plastic, or other suitable material and may be manufactured by turning on a lathe, casting or by other suitable means.

A flow directing member 50 is mounted on tube 20 within separation container 42. This flow directing member 50 is composed of a shroud 52, an apron 54, and a skirt 56. This flow directing member 50 is mounted on tube 20 by means of a pin 58, or other suitable mounting means, which also holds luminal plug 30 within tube 20. Thus, rotation of tube 20 rotates flow directing member 50. The flow directing member 50 may be formed of metal, plastic or other suitable material; may be solid or hollow; and has an axial lumen through which tube 20 is inserted.

A sleeve 60 encircles the lower end of tube 20 and is fastened thereto by screws 46, or other suitable means so that it too rotates with tube 20. The upper portion of sleeve 60 begins immediately below the discharge ports 28 of tube 20 and forms a flat mesa 62. The sleeve 60 then extends downward to an outward flare forming a shelf 64. The sleeve is annular in outline and continues down the tube 20 through the bottom member 48 and continuing down to end near the bottom plate 38 of housing 32.

Where the sleeve 60 passes through the bottom member 48 an annular passage 66 is formed through which materials may be discharged from the separation container 42. The inner wall of this passage 66 is formed by sleeve 60, and the outer wall by the bottom member 48.

A discharge receptacle 68 is mounted below the separation container 42 and surrounds tube 20, lower portion of sleeve 60, and the lower portion of the bottom member 48. The receptacle 68 is supported (not rotatable) by bearings 70 on the sleeve and by bearings 34 on the bottom member 48. Thus, the annular passage 66 enters the discharge receptacle 68 which has a space 71 which then exits via an exit pipe 72. The exit pipe 72 may have a means of regulating flow (not shown) on it, such as a valve, spigot, or the like.

Within the separation container 42, a series of spaces are defined by the various structural elements. Between the inner surface 74 of top member 44 and shroud 52 a generally wedge-shaped space is formed, termed the induction chamber 76. In continuity with this space, and defined by the wall of separation chamber 78 and apron 54 is an area called the injection channel 80. The size of the injection channel may be varied by an aperture ring (not shown) at the periphery of shroud 52 or apron 54. The area within the separation container 42 below injection channel 80 and above the mesa 62 is called the separation chamber 82. The contiguous space below mesa 62 and ending at shelf 64 and peripheral passage 66 is called the moat 84.

We will now describe the operation of the embodiment of FIG. 1 just described.

Rotation is provided by pulley 40 connected by a belt, not shown, to a motor or other motive means. This causes tube 20, separation container 42, top member 44, flow directing member 50, bottom member 48 and sleeve 60 to rotate together. A flow of a mixture with components to be separated is then fed into inlet tube 22. This mixture may be any combination of gases, liquids and solids. The mixture then passes down rotating tube 20 to inlet ports 26 and then into induction chamber 76. Rotational energy is imparted to the mixture by the rotating tube 20 and by being forced radially outward by shroud 52 from the inlet ports 26. The induction chamber 76 is generally wedge-shaped. The outlet of the induction chamber 76, at the beginning or top of the injection channel 80, should have a flow area equal to, or less than, the flow area of the inlet ports 26, to prevent flow starvation.

The mixture density, rotational speed, radial position and elevation establish each point on the isobar 92 paraboloid. The simultaneous solution of the equation for the critical orbital position and the equation for the associated critical isobar yields the pressure level that exists at a specific injection channel position. This is the pressure needed to inject the mixture flow from the induction chamber area into the separation chamber at an orbital position needed to assure separation of the desired size/density component.

Figure 6:
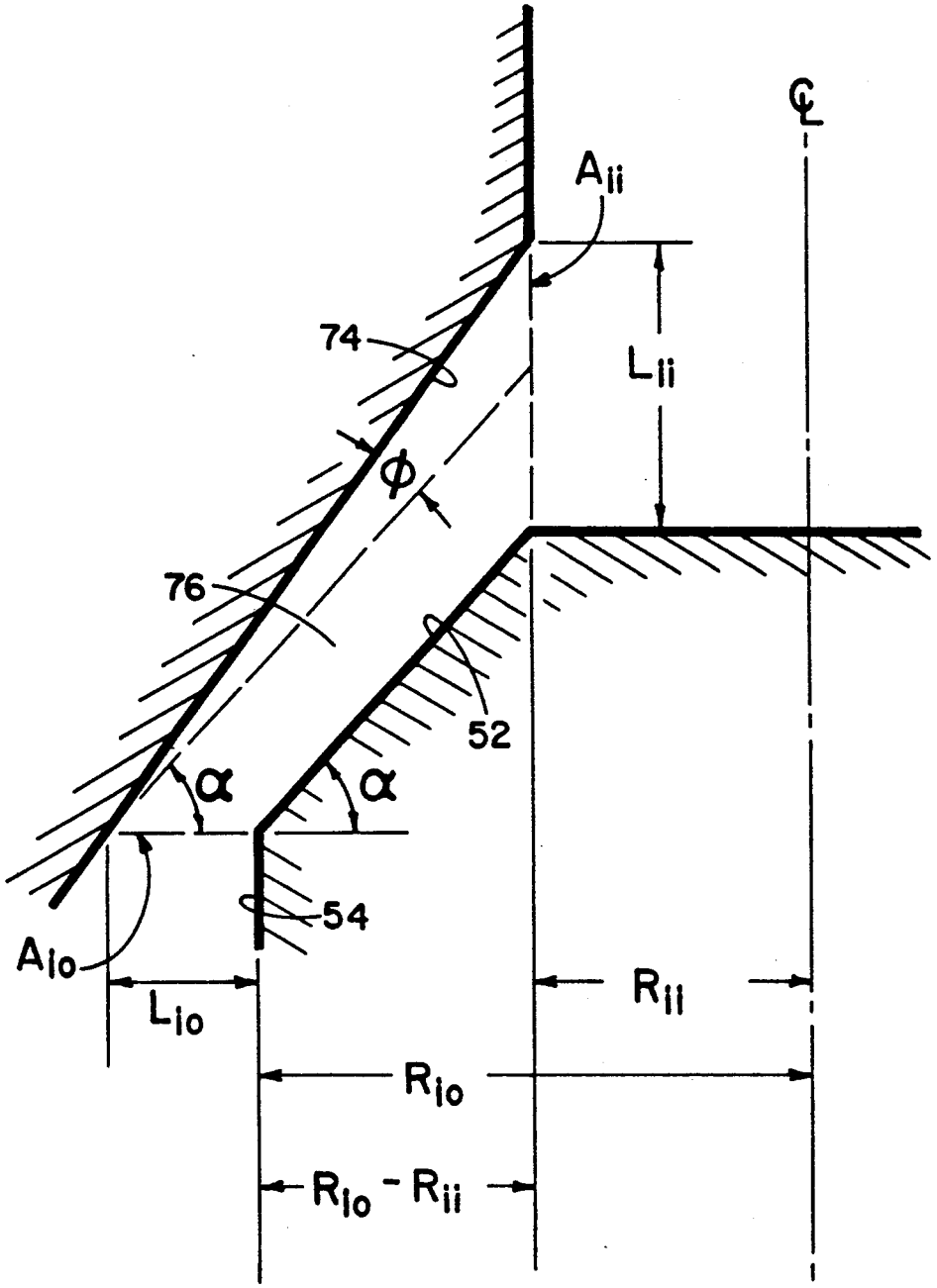
FIG. 6 is a detailed cross-section of the induction chamber.

The induction chamber 76 is generally wedge-shaped as shown in detail in FIG. 6. The wedge angle $\phi$ (Theta) is important in maintaining a constant mass flow rate through the induction chamber 76. To accomplish this, the flow area at the wedge outlet $A_{io}$ must be less than or equal to the flow inlet area $A_{ii}$. Under critical design conditions (with no flow saturation or over pressurization), the following relationships should hold:

$$\phi = \text{tangent}^{-1}\left[\frac{L_{ii} + (R_{io} - R_{ii})\tan\alpha}{(R_{io} - R_{ii} + L_{io})}\right] - \alpha$$

Where:

$\phi$ = The wedge angle of the induction chamber
$\alpha$ = The shroud angle
$A_{ii}$ = Flow inlet area
$A_{io}$ = Wedge outlet area
$R_{ii}$ = The minor radius of the shroud
$R_{io}$ = The major radius of the shroud
$L_{ii}$ = Inlet flow clearance
$L_{io}$ = Outlet flow regulation clearance and $$L_{io} = -R_{io} + \sqrt{R_{io}^2 + 2L_{ii}R_{ii}}$$

Figure 2:
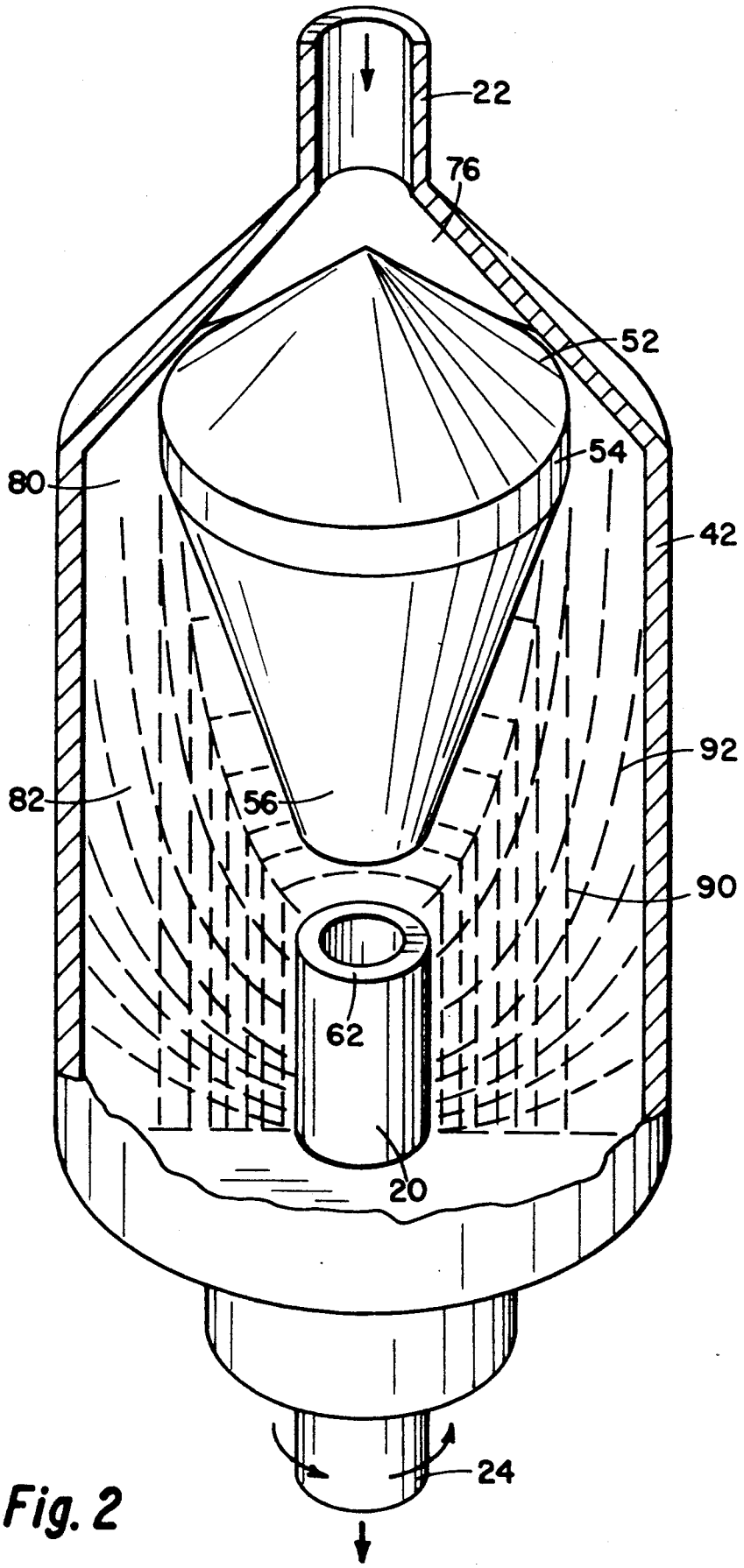
FIG. 2 is a diagrammatical view showing the flow pattern within the separation container.

From the induction chamber 76 the mixture then enters the injection channel 80 and then into the separation chamber 82. It is helpful, at this point, to refer to FIG. 2, which is a non-mechanical drawing of the device showing orbits of constant energy 90. The more peripheral orbits have higher energy than do near axial orbits. The mixture is injected into high energy orbit in the separation container 42. Thus, the more dense components of the mixture are already in the high energy orbits necessary to effect separation—in contrast to the usual centrifugal separator where the more dense components must "fight" their way to the peripheral high energy orbits. The less dense components at the periphery follow the isobaric paraboloids 92 (lines of pressures) inwardly and exit at the mesa 62.

Referring again to FIG. 1, the skirt 56 of the flow directing member 50 maintains the peripheral orientation of the mixture in the upper portion of separation chamber 82 and allows gradual inward movement of the less dense components of the mixture as skirt 56 tapers toward mesa 62. This prevents "sneak flow" of mixture to the axial area beneath apron 54 thus preventing contamination, and this configuration further prevents cavitation and vacuum formation axially.

As flow continues down separation chamber 82 the less dense components migrate axially and are discharged via discharge ports 28 into the lumen of the tube 20 and thence out the discharge tube 24. A means of controlling the flow in the discharge tube 24 may be incorporated (not shown).

The more dense components remain peripherally and enter moat 84 and from there may be discharged via a peripheral passage 66 into the space 71 in the discharge receptacle 68, and out the exit pipe 72. Discharge may be continuous or periodic. Flow may be controlled in exit pipe 72 by a valve, spigot or other flow controlling means.

In the embodiment of FIG. 1, when the member 64 is fully downwardly positioned, passageway 66 is fully closed. Thus, the discharge passageway 66 may be varied from fully open (as shown in FIG. 1) to fully closed to thereby permit the operator to adjust the rate of discharge of the heavy component of the mixture. While not shown in FIG. 1, a yoke may be provided for raising and lowering the shelf member 64 from means external of housing 32.

It is well to point out that the flow pattern exhibited within the separation chamber is one of the unique features of this invention. The following is out perception of the operational features of our invention and reference to FIG. 2 may be helpful for a full understanding of the invention. The mixture flow enters the chamber at the top and periphery with a uniform rotational velocity causing solid body rotation. The mixture possesses a two dimensional vector having a slight radially inward component as well as a strong downward directional component. Since horizontal frictionless flow occurs in the separation chamber, the isobars 92 should represent areas where acceleration is everywhere equal to zero. The resulting flow is such that the centripetal acceleration exactly balances the horizontal pressure force. In addition, the inertial flow, which is the flow that occurs in the absence of external forces, causes the high density components to move to the exit port 66.

By varying the speed of rotation, the pressure needed to inject a mixture flow into the chamber 76 and centrifugal force can be changed. This will also change the slope of isobaric paraboloids 92. This slope can be made essentially vertical which will result in minimal drag force and maximum separation force.

The rotation of the separation chamber 82 produces concentric energy orbits 90 about the axis of rotation. These orbits 90 are constant energy orbits for the components of the mixture being separated. The greater the distance a given orbit is from the center axis, the greater its energy level and the greater its separation potential.

A particle in orbit about the central axis is forced outwardly by centrifugal force and inwardly by centripetal force created by the drag of the mixture components moving centrally. If the particle is in low energy orbit, the drag force of the mixture may exceed the centrifugal force and cause the particle to move axially to the exit. If the centrifugal and centripetal forces balance, then the particle will remain in orbit and gravity will cause the particle to descend to the moat area where it can be separated peripherally. When centrifugal force exceeds centripetal force on the particle, it is moved toward the outer periphery of the separation chamber 82. The movement of the particle, as described above, depends on particle size/density and the viscosity/density of the other components of the mixture. The final position of the particle in the various orbits is its equilibrium orbit where centrifugal and centripetal forces are equal.

When a given particle size/density separation is to be achieved, it is important that the mixture be injected into an orbit of greater energy than the equilibrium orbit, to achieve optimum separation. This may be achieved by varying rotational speed, diameter of the chamber, force of injection and the like.

One use of the device of this disclosure relates to fluid-fluid separation, such as oil in water. When the host fluid (water) enters the moat area 84, it is extracted continuously (for example, by an overflow sump) and the contaminated oil-water moves to the mesa area 62 discharge port 28. By using a properly dimensioned aperture 26 and shroud 52 the oil component will enter the separation chamber 82 and ride in on the inner paraboloidal envelope 92 of the water. The water in the inlet fluid will immediately join and displace the water in the paraboloid while the oil, which is not at a high enough orbital energy to penetrate the water, escapes. This means that trace amounts of oil can be removed from bulk water.

Another application of the invention is fluid-solid separation as in mineral/ore separations. In this, the ore is pulverized and placed in a liquid carrier for separation in the device. If a dense fluid is used (one heavier than the component of the ore to be extracted) the ore component will be discharged axially 28. If a lighter fluid is used, the ore component will be discharged peripherally 66.

Figure 4:
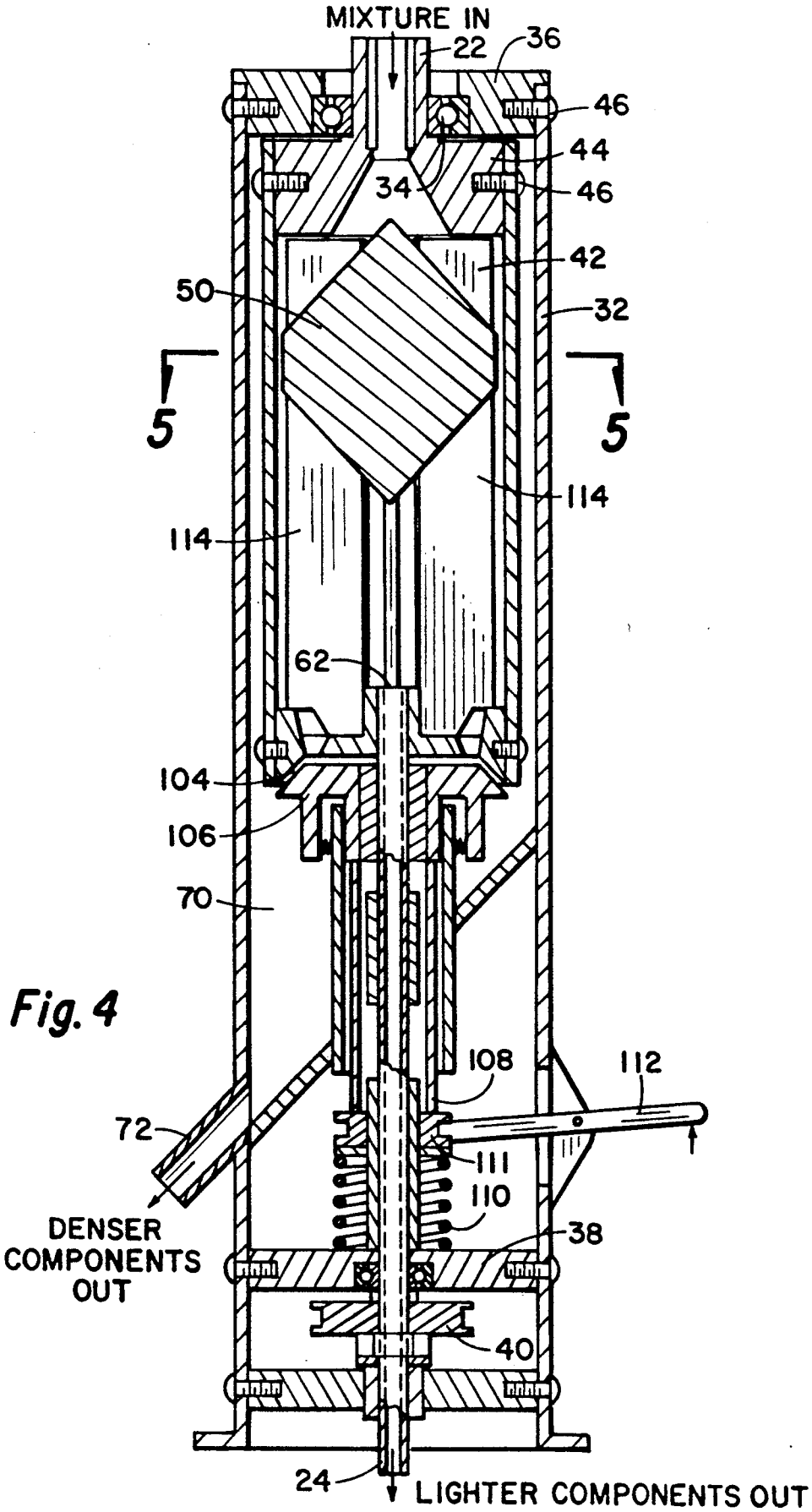
FIG. 4 is a longitudinal cross-sectional cut away view of still another alternate embodiment showing a non-continuous central tube and showing a discharge passage closing means utilizing a lever and springs and radial fins.

An example of gas-liquid-solid separation would be separation employing the embodiment of FIG. 4 of the components of smog. Radial fins 114 are used to maintain solid body rotation in gaseous separations. The solids and water droplets are separated through passageway 104, while the gas (air) is vented through the axial opening 62. The device can also be used to degas liquids (gas-liquid) separation.

Other possible uses of this device would include, but are not limited to, separation of milk components (liquid-liquid separation or liquid-solid separation), separation of blood components (plasmapheresis, etc.), water purification (removal of bacteria and particulate matter), removal of contaminants in smoke emissions (smokestack scrubber), and the like.

Figure 3:
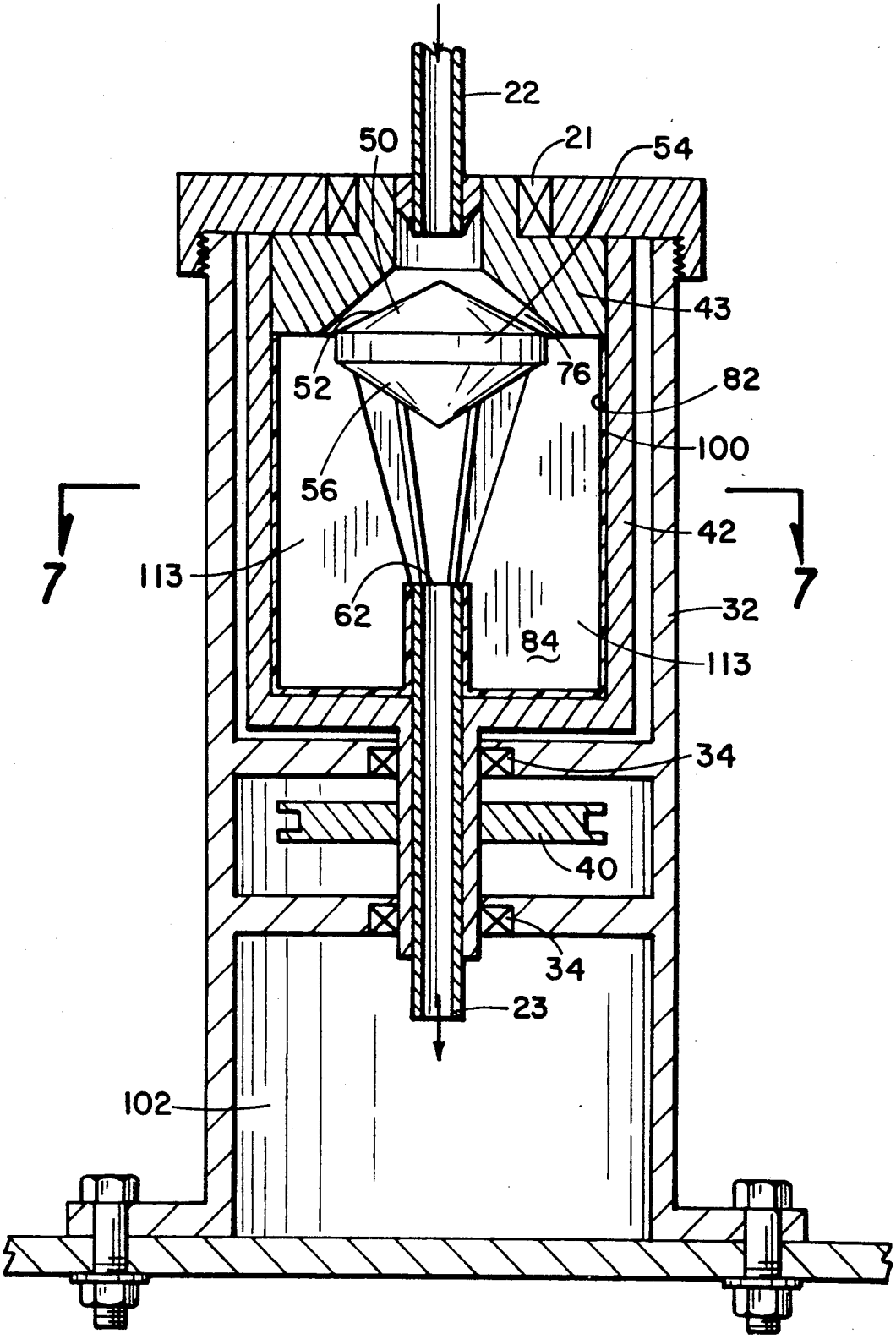
FIG. 3 is a longitudinal cross-sectional cut away view of an alternate embodiment showing a non-continuous tube, a liner contained within the separation chamber and a collection chamber for the less dense components.
Figure 7:
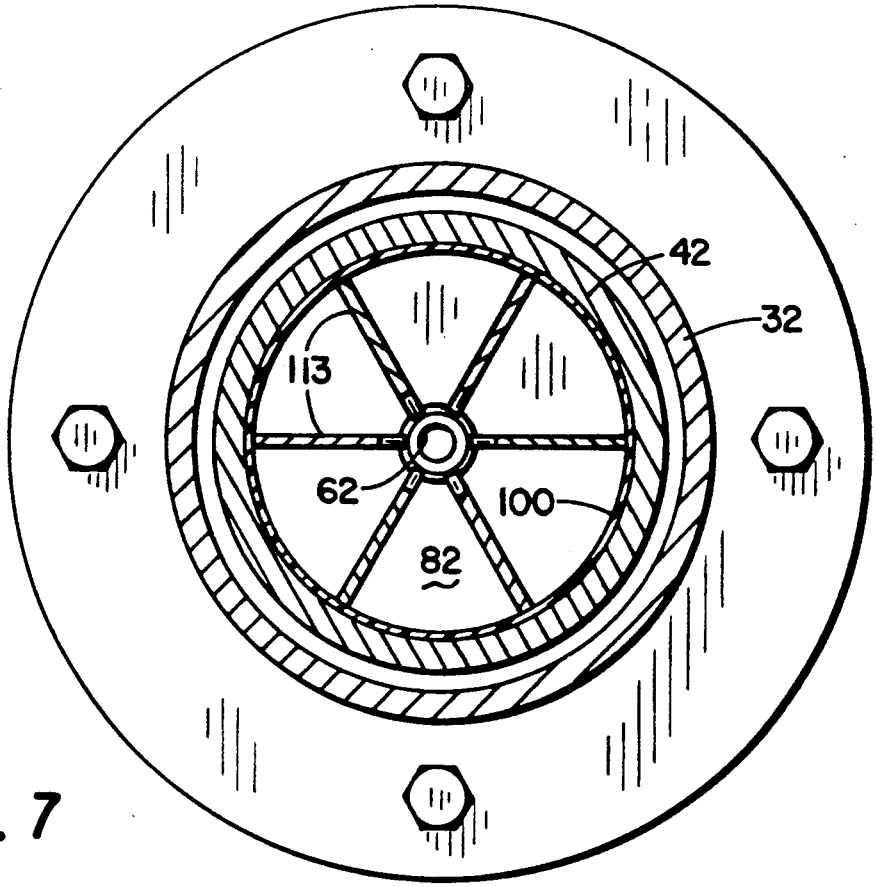
FIG. 7 is a cross-sectional view taken along the line 7—7 of FIG. 3.

Other embodiments of the invention have been tried and found to be workable. FIG. 3 illustrates an embodiment in which there is no outlet for the more dense components. The more dense components settle in the separator chamber 82 downwardly into the moat 84 and are removed after separation by removing the liner 100 which is contained within the separation container 42. This liner may be plastic, or other suitable material. The less dense components of the mixture are discharged through an axial discharge tube 23 into a collection chamber 102 which may be drained continuously, or periodically. The inlet tube 22 empties into and ends at the induction chamber 76. Flow director 50 is supported by radial fins 113, as shown best in FIG. 7. Tube 23 is rotatably supported by bearings 34 from the housing and top member 43 is supported by bearings 21 from the housing. Rotating pulley 40 rotates in unison with tubes 22 and 23, separation container 42, and fins 113 which support flow director 50. Top member 43 and liner 100 are also rotated.

While the embodiment of FIG. 3 does not provide an outlet for the separated heavier component, such outlet may be of a type which is in the form of an opening concentric with inlet tube 22.

Figure 5:
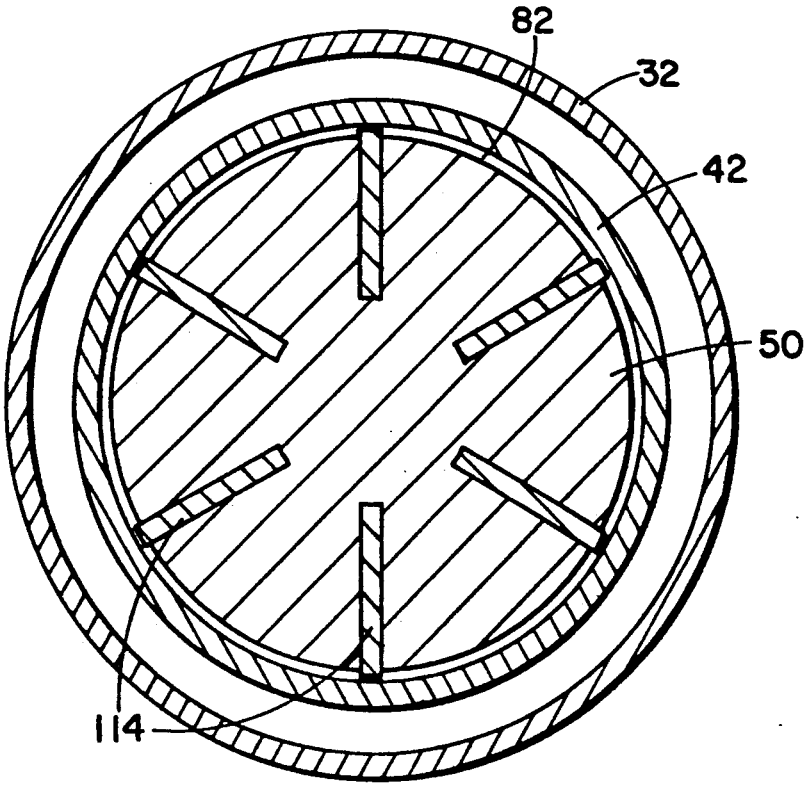
FIG. 5 is a cross-sectional view of FIG. 4 at the line 5—5.

Another embodiment, that has proven useful, is shown in FIG. 4. As in FIG. 3, the central axial tube 20 (in FIG. 1) is not continuous. The heavier, more dense components of the mixture again are discharged peripherally through a discharge passage 104 which empties into a space 70 and thence out an exit pipe 72, much like the embodiment in FIG. 1. However, the discharge passage 104 is variable, and is normally in a closed position. This is accomplished by a closing member 106 which is urged upward closing the passage 106 by a sleeve 108 which is kept in the upward position by a spring 110. Yoke 111 is positioned between the spring 110 and the sleeve 108. By pushing downward on the yoke 111, compressing spring 110 by means of the lever 112, the sleeve 108 drops and allows the closing member 106 to move downward and open the discharge passage 104. A further feature in FIG. 4 is a series of radial fins 114 which extend from the flow directing member 50 to the wall of the separation container 42. The fins 114 thus divide the separation chamber 82 into a series of wedgeshaped spaces, as shown in the cross-section of FIG. 5.

The fins 114 may be included in any of the embodiments. The fins 114, by compartmentalizing the separation chamber 82, promote solid body rotation of the mixture and enhance separation.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An orbital separator device for separating the components of a mixture, comprising:

a tube having a central axis with an inlet end and a discharge end, the tube being centrally mounted in a support structure for rotation about its central axis and having a lumen and walls;

a separation container having an interior wall forming a separation chamber with an entrance end and an exit end placed around said tube and forming a space between said tube and the interior wall of said separation container;

a top member closing said space between said tube and said interior wall of the separation container at said entrance end of said separation container and near said inlet end of said tube;

a bottom member closing said space between said tube and said interior wall of the separation container at said exit end of said separation container and near said discharge end of said tube;

a flow directing member mounted on said tube between said top member and said bottom member;

means for introducing a flow of the mixture to be separated into the lumen of said inlet end of said tube;

at least one inlet port through the wall of said tube allowing said mixture flow to enter said separation chamber between said top member and said flow directing member;

one or more discharge ports through the wall of said tube between said flow directing member and said bottom member for removing the less dense components of said mixture from said separation container;

a passage through said bottom member for removing the more dense components of said mixture from said separation container;

means for occluding the lumen of said tube between said inlet port and said discharge port; and means for rotating said tube.

2. The device, as described in claim 1, wherein said passage through said bottom member for removing the more dense components of said mixture is connected to an exit pipe.

3. The device, as described in claim 1, in which said top member has an inverted conical shaped section and has a peripheral end and the top of said flow directing member is tapered forming a wedge-shaped induction chamber between said conical and tapered surfaces.

4. The device, as described in claim 3, in which said wedged-shaped induction chamber is larger near said inlet port and smaller near its peripheral end.

5. The device, as defined in claim 4, in which said flow directing member has an annular band parallel to the central axis of said tube and continuous with said tapered top of said flow directing member forming an injection channel in the space between said annular band and the wall of said separation chamber, said injection channel being in continuity with said induction chamber.

6. The device, as defined in claim 5, in which said flow directing member has an upright conical shaped section extending downward from said annular band forming a skirt diverting said flow away from the axis.

7. The device, as defined in claim 1, in which said bottom member is formed of two parts: an outer annular member sealably connected to the wall of said separation chamber, and an inner annular sleeve sealed to said axial tube, with a discharge port disposed between the outer annular member and the annular sleeve.

8. The device, as defined in claim 7, in which said inner annular sleeve flares outwardly forming a sloping shelf extending from said axial tube to said discharge port.

9. An orbital separator for separating the components of a mixture, comprising:

a vertical tubular member having a central axis with an inlet end and a discharge end, the tubular member being mounted in a support structure for rotation about its central axis and having a lumen and walls;

a cylindrical separation container having an interior wall forming a separation chamber with an upper entrance end and a lower exit end, the separation chamber being affixed to and mounted coaxially around said tubular member and forming a space between said tubular member and the separation chamber;

a top member affixed to and rotated with said tubular member and positioned within said space between said tubular member and said interior wall of said separation chamber adjacent to said entrance end of said separation chamber, the top member having a downwardly and outwardly inclined, substantially conically shaped surface;

a flow directing member concentrically mounted on said tubular member within said separation chamber, said flow directing member being mounted below and spaced from the substantially conically shaped surface of said top member and having a conical upper surface, the angle of the substantially conically shaped surface of said top member being steeper than the angle of said conical upper surface of said flow directing member, wherein a wedge shaped induction chamber is formed there between;

means for introducing a flow of the mixture to be separated into the lumen of said inlet end of said tubular member and means for passing the flow out of said tubular member into said wedge shaped induction chamber;

means disposed below said flow directing member for removing less dense components of the mixture from said separation chamber; and means below said flow directing member of removing more dense components of the mixture from said separation chamber.

10. An orbital separator according to claim 9 including:

a bottom member affixed to and closing said separation chamber lower exit end.

11. An orbital separator according to claim 10 wherein said means of removing more dense components of the mixture from said separation chamber includes at least one opening in said bottom member.

12. An orbital separator as described in claim 11, wherein said opening in said bottom member for removing the more dense components of said mixture is connected to an exit pipe.

13. An orbital separator as defined in claim 10, in which said bottom member is formed of two parts, the first part being an outer annular member sealably connected to the wall of said separation chamber and the second part being an inner annular sleeve sealed to said tubular member, with a discharge port disposed between the outer annular member and the inner annular sleeve.

14. An orbital separator as defined in claim 13 in which said inner annular sleeve includes a portion that flares outwardly forming a sloping shelf surface extending from said tubular member.

15. An orbital separator as described in claim 9, in which said wedged-shaped induction chamber is larger at a location adjacent said tubular member and smaller at a location adjacent said separation container interior wall.

16. An orbital separator as defined in claim 9, in which said flow directing member is further defined by an annular band parallel to said tubular member central axis and continuous with the conical upper surface of said flow directing member.

17. An orbital separator as defined in claim 16, in which said flow directing member has a downwardly and inwardly tapered conical shaped section extending from said annular band forming a flow directing member skirt portion.

* * * * *